United States Patent [19]

Marcel

[11] Patent Number: 4,794,749

[45] Date of Patent: Jan. 3, 1989

[54] BUILDING SYSTEM

[76] Inventor: Antoine-Adel Marcel, P.O. Box 35005, Baghdad, Iraq

[21] Appl. No.: 4,185

[22] Filed: Jan. 16, 1987

Related U.S. Application Data

[63] Continuation of Ser. No. 673,377, Nov. 20, 1984, abandoned.

[51] Int. Cl.[4] ..... E04C 2/04

[52] U.S. Cl. ..... 52/611; 52/574; 52/589; 52/593

[58] Field of Search ..... 52/574, 589, 590, 593, 52/596, 609, 611, 588

[56] References Cited

U.S. PATENT DOCUMENTS

| | | | |
|---|---|---|---|
| 219,120 | 9/1879 | Schreier | 52/726 |
| 479,054 | 7/1892 | Briggs | 52/611 |
| 784,476 | 3/1905 | Davis | 52/609 |
| 837,163 | 11/1906 | Whisler | 52/608 |
| 959,846 | 5/1910 | D'Elia | 52/574 |
| 1,097,148 | 5/1914 | Swanson | 52/574 |
| 1,244,008 | 10/1917 | Wheeler | 52/574 |
| 1,265,220 | 5/1918 | Lyle | 52/611 |
| 1,467,340 | 9/1923 | Siegel | 52/285 |
| 1,534,177 | 4/1925 | Guest | 52/609 |
| 2,185,497 | 1/1940 | Cilento et al. | 52/98 |
| 4,034,533 | 7/1977 | Faas | 52/608 |
| 4,106,254 | 8/1978 | Jack et al. | 52/574 |
| 4,123,881 | 11/1978 | Muse | 52/611 |

FOREIGN PATENT DOCUMENTS

| | | | |
|---|---|---|---|
| 857038 | 12/1920 | Austria | 52/611 |
| 508118 | 1/1952 | Belgium . | |
| 807017 | 4/1951 | Fed. Rep. of Germany | 52/611 |
| 817505 | 8/1951 | Fed. Rep. of Germany . | |
| 851251 | 7/1952 | Fed. Rep. of Germany | 52/574 |
| 881996 | 5/1953 | Fed. Rep. of Germany | 52/611 |
| 1301457 | 8/1969 | Fed. Rep. of Germany | 52/611 |
| 955469 | 1/1950 | France . | |
| 1067762 | 6/1954 | France . | |
| 1191261 | 10/1959 | France | 52/590 |
| 1277974 | 12/1961 | France . | |
| 629092 | 3/1963 | France | 52/608 |
| 1321543 | 12/1963 | France . | |
| 2299468 | 8/1976 | France . | |
| 414384 | 8/1946 | Italy | 52/611 |
| 496593 | 7/1954 | Italy | 52/611 |
| 91586 | 2/1959 | Netherlands . | |
| 66451 | 5/1913 | Switzerland | 52/611 |
| 24576 | of 1909 | United Kingdom . | |
| 119045 | 9/1918 | United Kingdom . | |
| 151750 | 10/1920 | United Kingdom . | |
| 188995 | 11/1922 | United Kingdom . | |
| 210519 | 1/1924 | United Kingdom . | |
| 208541 | of 1925 | United Kingdom . | |
| 244632 | 12/1925 | United Kingdom . | |
| 392911 | 4/1933 | United Kingdom . | |
| 540561 | 10/1941 | United Kingdom . | |
| 569161 | 5/1945 | United Kingdom . | |
| 578894 | 7/1946 | United Kingdom . | |
| 590291 | 7/1947 | United Kingdom . | |
| 635159 | 4/1950 | United Kingdom . | |
| 760804 | 11/1956 | United Kingdom . | |
| 783527 | 9/1957 | United Kingdom . | |
| 1388117 | 3/1975 | United Kingdom . | |

*Primary Examiner*—John E. Murtagh
*Assistant Examiner*—Andrew Joseph Rudy
*Attorney, Agent, or Firm*—A. S. Weintraub

[57] ABSTRACT

A building system for the construction of walls, floors, roofs, paths and roads employs prefabricated blocks having compound shapes which are such that at least a majority thereof each exhibit projections or recesses arranged to co-operate interkeyingly with the projections or rcesses of other blocks of the system, whereby the blocks can be assembled without the essential use of mortar or other intervening binding material. The blocks may be substantially T- or Z-shaped, having a hollow formation and being flat-laid, or disposed upright, in horizontal courses in vertical walls. The hollow interiors of the blocks may be filled with strengthening material or heat-and sound-insulating material or reinforcing bars may extend through aligned hollow interiors in the superposed courses. Compound-shaped corner and junction blocks are employed, where required.

12 Claims, 16 Drawing Sheets

BUILDING SYSTEM

This application is a continuation, of application Ser. No. 673,377, filed 11-20-84 now aband.

BACKGROUND OF THE INVENTION

1. Field of the Invention

This invention relates to a building block system.

2. Description of the Prior Art

Various shapes of building blocks have been proposed over many years for use in building vertical and horizontal walls. A relatively common proposal is of substantially T-shaped blocks, i.e. a block consisting solely of a stem limb and a cross limb, the stem limb extending substantially perpendicularly from the middle of the cross limb, examples being disclosed in British Patent Specification No. 590,291, French Patent Specifications Nos. 1067762 and 2299468 and U.S. Pat. No. Re. 14,904. In all of these cases, the block is laid such that the cross limb extends in the general plane of the wall, whilst the stem limb extends perpendicularly to that plane.

Swedish Patent Specification No. 150829 discloses a building block which, although it appears to be substantially T-shaped when seen in front elevation and rear elevation. The block actually consists of six limbs, of which four provide the front and rear T-shapes and of which each of the other two, links one end of the cross-limb of the front T-shape with the nearer end of the cross-limb of the rear T-shape. This building block has this special shape because it is used to form ventilation or like channels in the wall.

Although substantially T-shaped blocks, when interfitted with the free end of each stem limb face-to-face with the cross limbs of two adjacent blocks, utilize the interfitting to support each other at two opposite sides of the six sides of the block, they provide no similar support at any of the other four sides.

U.S. Pat. Ser. No. 829,480 discloses a paving and building block system wherein each block consists of two block-form parts whereof a larger part protrudes from the smaller part on four sides. These blocks can interfit such that the larger parts of four outer blocks overlap the larger part of an inner block at its respective four sides. Although forces applied to the major external face of the larger part of the inner block are borne by the larger parts of the four outer blocks, forces applied to the major external face of the smaller part of the inner block are not borne by any adjacent blocks.

In the above-mentioned U.S. Pat. No. Re. 14,904, each block has the end faces of its cross limb diverging towards its stem limb, and has the lateral faces of its stem limb substantially parallel to the respective nearer end faces of its cross limb and thus diverging away from the cross limb. Moreover, those two intermediate faces of the cross limb between these respective end faces, on the one hand, and these respective lateral faces, on the other hand, converge towards the longitudinal axis of the cross limb progressing inwardly. There is thus formed a keying arrangement of substantially Z-form which, in a wall constructed from the blocks, resists forces on those faces of any one of the blocks at the major faces of the wall. However, only one shape of block with such keying arrangement is provided, so that the system is of very limited use. Although the Specification discloses use of the blocks in a vertical wall, the blocks are arranged with their cross limbs vertical and their stem limbs horizontal. Thus, a bottom layer of special blocks has to be provided if the wall is to be laid on a planar foundation.

Federal German Patent Specification No. 1926239 discloses paving slabs each of which has at each of two opposite edge sides thereof a profile including a substantially Z-form key, the profiles on most of the slabs being identical to each other. The substantially Z-form keys of each slab are arranged to extend parallel to each other in the plane of the horizontal wall formed by the slabs. However, they are offset relative to each other along the respective opposite edge sides of the slab and are thus unsuitable for use in building a vertical wall with the substantially Z-form keys extending horizontally.

French Patent Specification No. 1352121 discloses a building system employing three shapes of interfittable elements, these shapes being substantially Z, substantially T and substantially L-shaped. However, forces against the free end face of the stem limb of such T-shaped element or against the free end face of the longer limb of such L-shaped element are not borne by the adjacent elements except by way of conventional fastening means, for example riveting, used to fix the elements together.

SUMMARY OF THE INVENTION

This invention seeks to provide a building system in which blocks are employed that are of compound shape, that is to say, are not basically rectangular parallelepipeds. The block employed in a system in accordance with the invention may be substantially T-shaped, substantially Z-shaped or may be dove-tailed and may co-operate with other compound-shaped blocks to produce buildings or other structures in which the various blocks strengthen and support one another with, or without, interlocking cooperation. It is possible for the buildings or other structures to be completed, in some cases, without mortar or other binding material between the blocks or, in other cases, to employ a relatively small amount of mortar or other binding material between the blocks as compared with buildings and other structures produced from conventional blocks, particularly bricks.

The present system advantageously employs blocks which are pre-fabricated to a high degree of precision and with which the required fitting together, especially interlocking, of the blocks will not be achieved, during the erection of a building or other structure, unless the individual blocks are correctly disposed relative to one another and register accurately. Thus, if a mistake is made in positioning a block relative to others that have already been laid, the error is almost immediately very obvious and can quickly and easily be corrected. No cutting or breaking of any block is necessary since the system advantageously includes the use of complementary blocks such as end blocks, corner blocks, or junction blocks. In the case of a building or other structure having upright walls, a minimum of checking is necessary upon the erection of those walls once the dimensions of the base of the building has been calculated and said base has been accurately marked out. An important feature of the system is the fact that the same block can by employed in the construction of floors and roofs as are used to erect vertical walls thus producing a fully integrated building system in which, once an initial choice of the various possible block shapes has been made, the number of different shapes of pre-fabricated block that are actually employed in a single building or other structure can be quite small.

According to one aspect of the present invention, there is provided a wall comprising a plurality of unitary building blocks each consisting of only two limbs which are a stem limb and a cross limb, the stem limb extending substantially perpendicularly from the middle of the cross limb, and the longitudinal axis of the cross limb extending in the general plane of the wall, wherein the improvement comprises the longitudinal axis of the stem limb also lying in said general plane.

Use of T-blocks in this manner in a wall, which may be a vertical wall, or a horizontal wall, for example a floor or a roof, gives a greater degree of flexibility in building construction, in particular with walls intended to bear no load or low loads, since these walls can be of lesser thickness than when the stem limbs of the blocks are perpendicular to the general plane.

According to another aspect of the present invention, there is provided a unitary building block comprising only two block-form parts whereof one part protrudes from the other part at first and second adjacent sides of said block to provide first and second keys thereat, wherein the improvement comprises said other part protruding from said one part at third and fourth adjacent sides of said block to provide third and fourth keys thereat.

This building block has the advantage that, when interfitted with identical building blocks in a wall, the blocks support each other not only against forces applied to two opposite sides of the block but also against forces applied to another two sides of the block.

According to a third aspect of the present invention, there is provided a range of building elements of various shapes, wherein the improvement is comprised in that the elements of various shapes are provided with substantially Z-form keys which are of substantially identical linear and angular dimensions to each other and each of which has its intermediate limb at an acute angle to its other two limbs.

This provision of substantially Z-keys on a range of variously shaped elements gives a greater degree of flexibility and strength in building construction.

According to a fourth aspect of the present invention, there is provided a substantially vertical wall comprising a plurality of unitary building blocks each formed at first and second opposite sides thereof with substantially Z-form keys. The keys of said blocks are substantially identical to each other and interfitting, and each block having at third and fourth opposite sides thereof alternating with said first and second opposite sides thereof respective substantially parallel faces. The improvement comprises said faces and the substantially Z-forms of the keys of the blocks extending in substantially horizontal planes.

A vertical wall constructed in this manner with blocks provided with Z-keys has the advantage that a lowermost course of the blocks can be laid directly on a horizontal foundation surface without requiring interposition of differently shaped blocks.

According to a fifth aspect of the present invention, there is provided a building block including at first and second opposite sides thereof respective first and second substantially Z-form keys whereof the substantially Z-forms extend in a substantially parallel manner to each other. The improvement comprises the first and second keys being situated directly opposite each other along said sides.

This block has the advantage that a plurality of them can be laid with their keys interfitting without requiring inversion of alternate blocks and without alternate blocks protruding significantly.

According to a sixth aspect of the present invention, there is provided a wall comprising a plurality of unitary building blocks each consisting of only two limbs which are a stem limb and a cross limb. The stem limb extends substantially perpendicularly from the middle of the cross limb, and the longitudinal axis of the cross limb extends in the general plane of the wall. The improvement comprises the longitudinal axes of the stem limbs of some of the blocks extending in said general plane and the longitudinal axes of the stem limbs of others of the blocks extending perpendicularly to said stem limbs of some of the blocks.

This arrangement of substantially T-shaped blocks is particularly useful in providing a relatively strong wall.

BRIEF DESCRIPTION OF THE DRAWINGS

In order that the invention may be clearly understood and readily carried into effect, reference will now be made, by way of example, to the accompanying drawings, in which.

DESCRIPTION OF THE PREFERRED EMBODIMENTS

Figure 1:
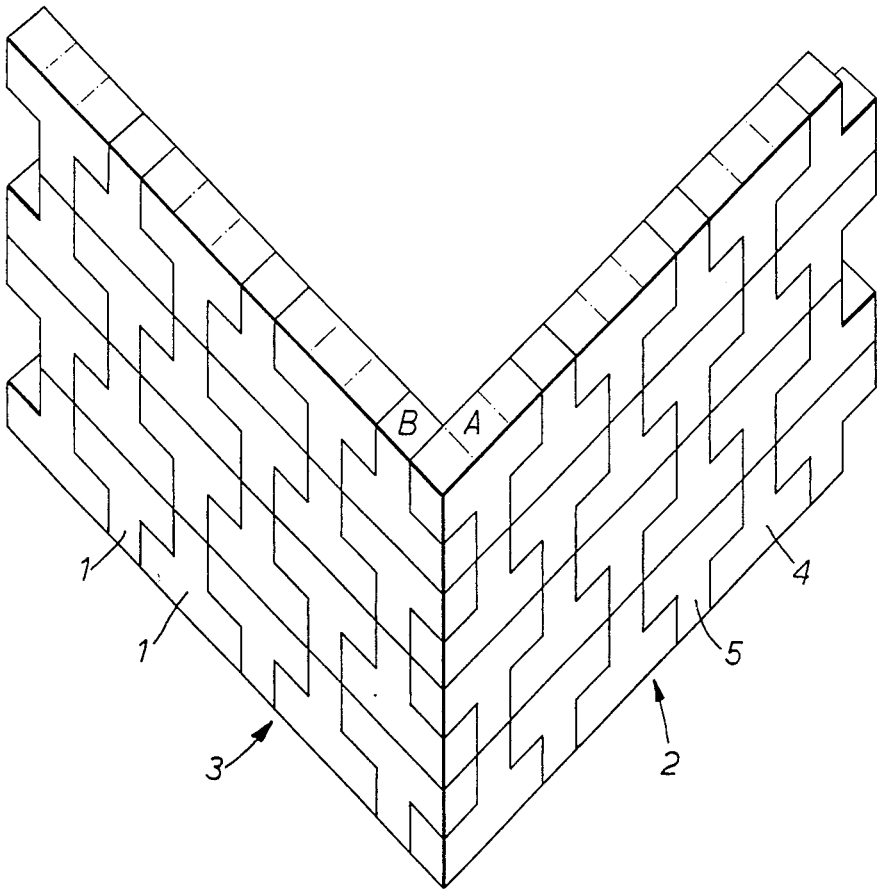
FIG. 1 shows a perspective view from above of a corner of two vertical walls of identical substantially T-shaped blocks of a building block system.
Figure 2:
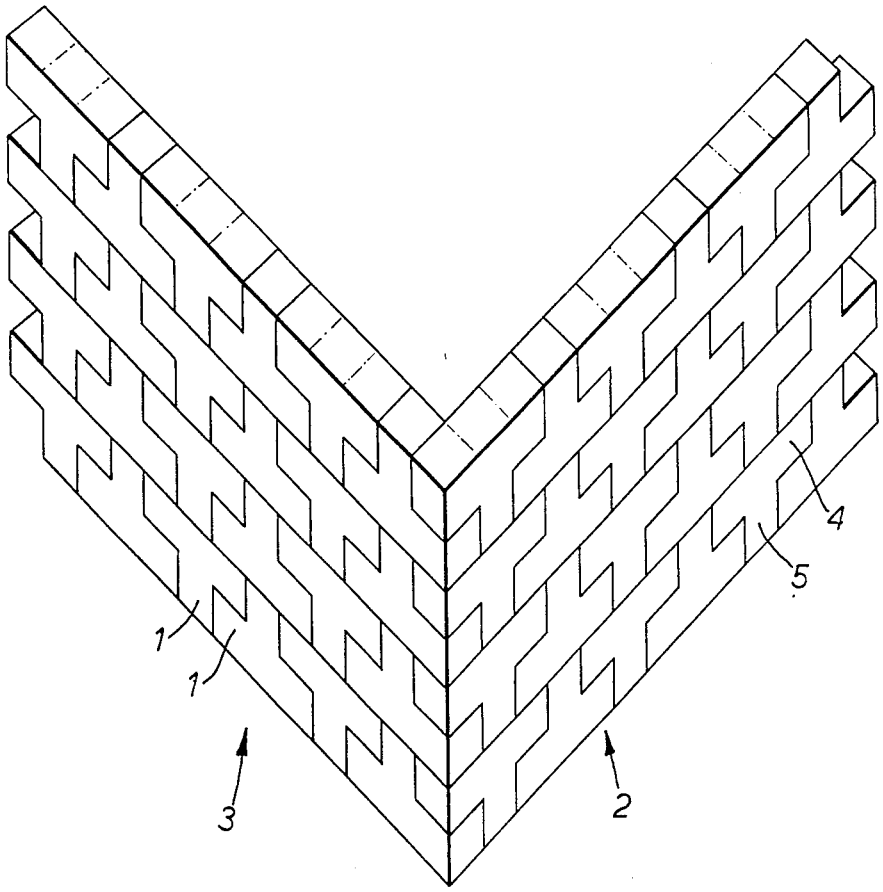
FIG. 2 shows a view similar to FIG. 1 of a modified arrangement of the substantially T-shaped blocks in the walls.

Reference is made firstly to FIGS. 1 to 15 of the drawings which show the use of building blocks 1 that are substantially T-shaped. FIGS. 1 and 2 of the drawings show two upright walls 2 and 3 of a building or other structure formed from such T-shaped blocks. It will be seen that, in each horizontal course of blocks, neighboring blocks are alternately upright and inverted and that, in the structure of FIG. 1, each block is inverted relative to blocks which are vertically thereabove or therebeneath. In the structure shown in FIG. 2, each block in each course has the same disposition as does each block which is vertically thereabove or therebeneath. It will particularly be noted that, in both cases, the T-shaped blocks co-operate to form a 90° junction between the two upright walls without the need to employ blocks of any other shape. It will immediately be apparent that, measured in the general plane of its wall, the horizontal or cross limb 4 of each block is three units long, the vertical or stem limb 5 thereof is one unit long, and each limb 4 and 5 is one unit wide.

Figure 3A:
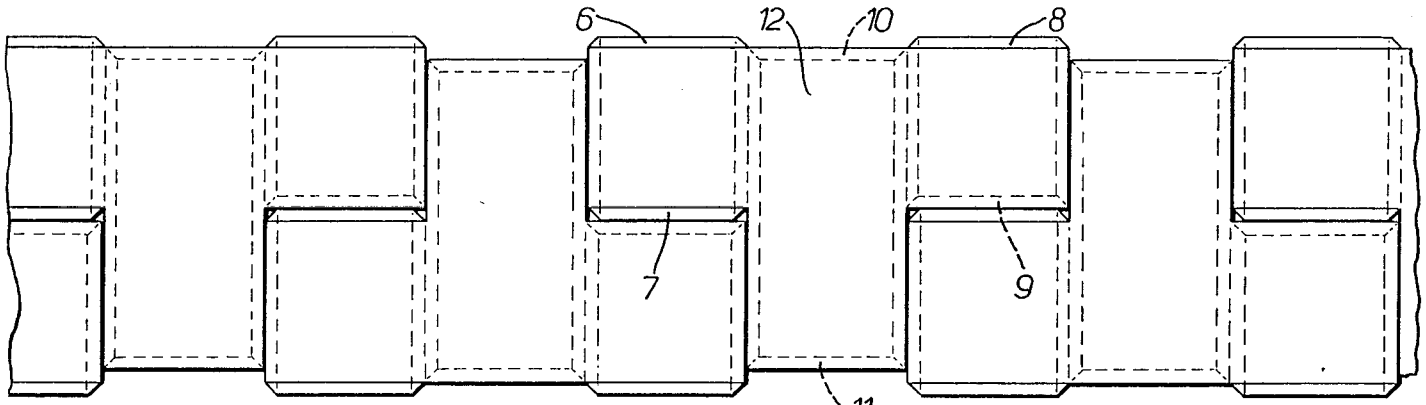
FIGS. 3A and 3B are a fragmentary elevation and a fragmentary plan view of a course of blocks in a wall of FIG. 1 or 2, FIGS. 4A and 4B are a perspective view and a vertical sectional perspective view of one of the blocks of that course.
Figure 3B:
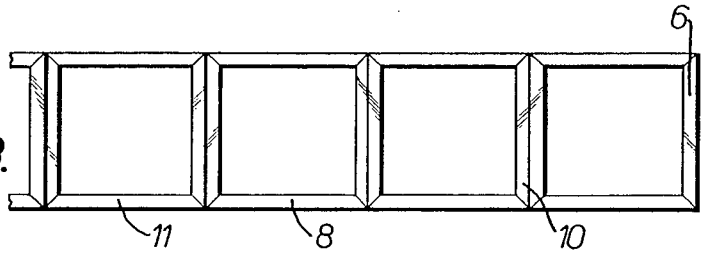
Figure 4A:
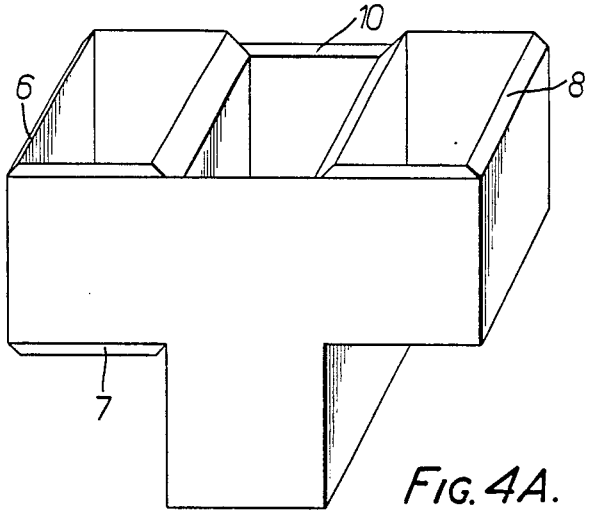
Figure 4B:
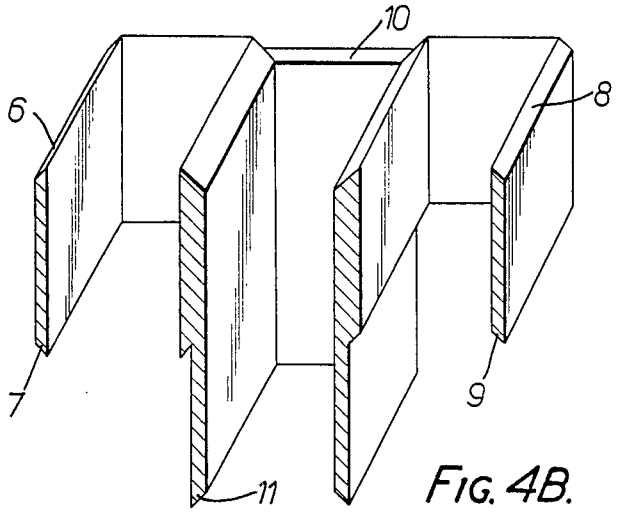
Figure 5A:
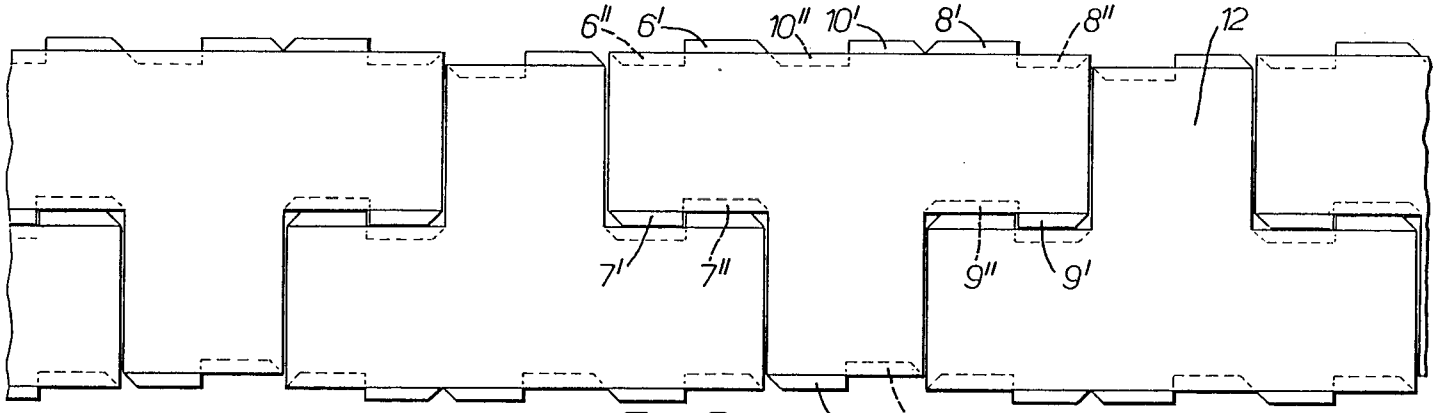
FIGS. 5A and 5B are views similar to FIGS. 3A and 3B of the course with a modified version of the block.
Figure 5B:
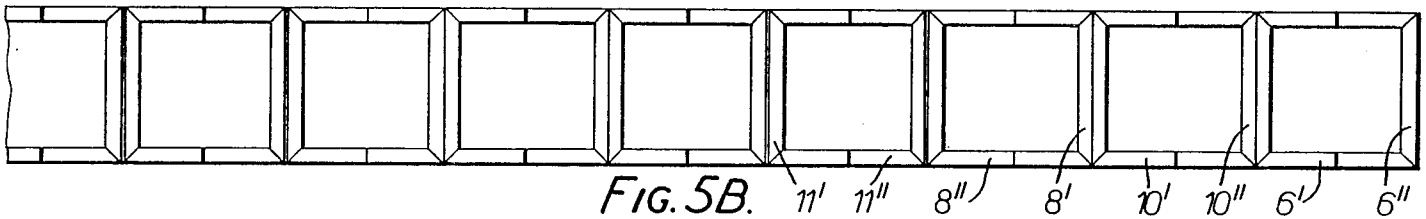

In fact, the basic T-shaped block of FIGS. 1 and 2 is preferably given tapered projections 6 to 8 and depressions 9 to 11 as shown in FIGS. 3 and 4 for a hollow block 12 and each one unit square in effective area, or projections 6′ to 11′ and depressions 6″ to 11″ each with an effective area of one unit by one-half unit, as shown in FIGS. 5. These projections and depressions provide significant keys between the blocks 12, enabling them to be fitted satisfactorily together without the use of mortar or other binding material when a wholly or principally dry construction is required. Moreover, the projections and depressions co-operate with each other to form satisfactory seals at the joints between the blocks which is a considerable advantage if the hollow blocks are to be filled with an initially foamed or liquid insulation material or with foamed or other concrete.

Figure 6A:
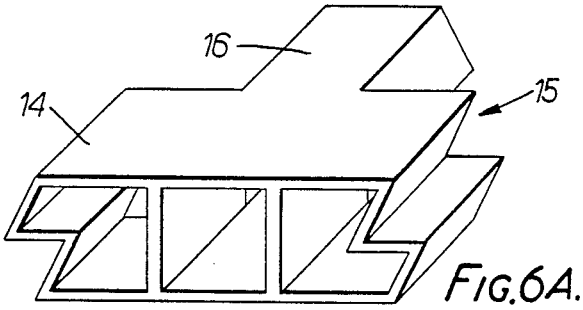
FIGS. 6A, 6B and 6C are a perspective view, a plan view and another perspective view of a second modified version of the substantially T-shaped block.
Figure 6B:
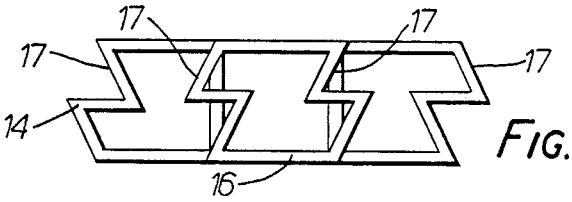
Figure 6C:
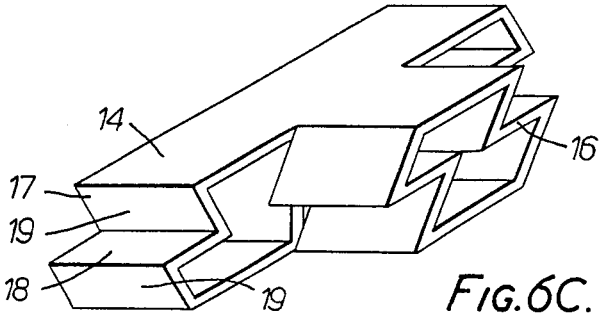
Figure 7A:
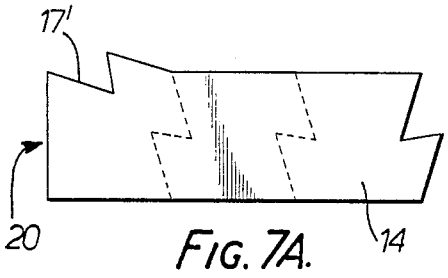
FIGS. 7A and 7B are a plan view and a perspective view of a corner substantially T-shaped block usable with the block of FIG. 6A, FIGS. 8A and 8B are a perspective view and a plan view of two of those corner blocks interfitted.
Figure 7B:
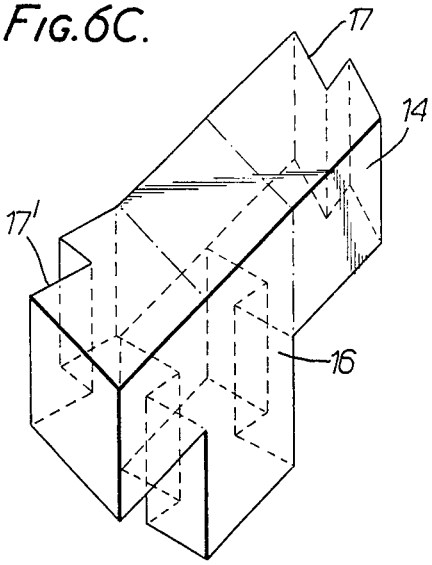
Figure 8A:
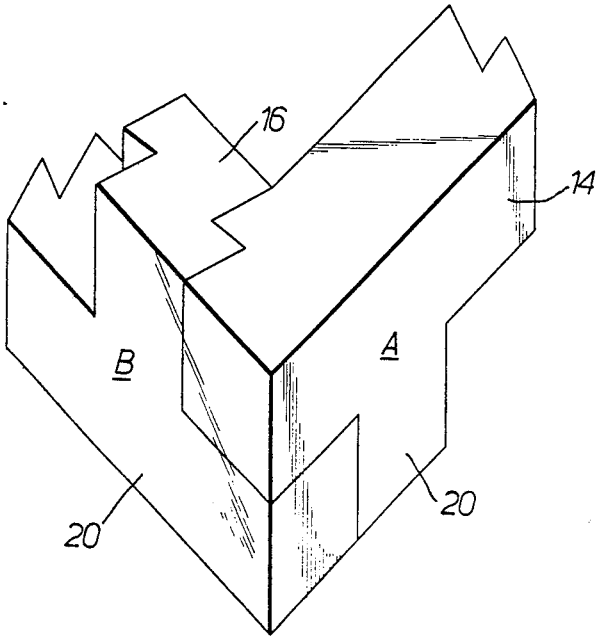
Figure 8B:
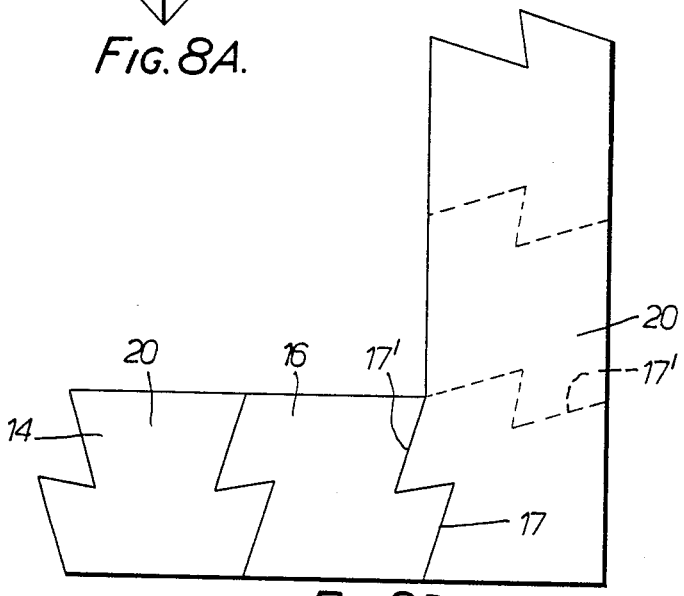

FIGS. 6, 7 and 8 of the drawings illustrate the form and use of blocks which may conveniently be described as Z-key, T-blocks. In FIGS. 6, the end faces of the cross limb 14 of the substantially T-shaped block 15 and the lateral faces of the stem limb 16 thereof are of a shape to give substantially Z-form keys 17. The keys 17 are identical to each other, especially in their linear and angular cross-sectional dimensions, with the intermediate limb 18 of each key being at an acute angle to its other two limbs 19. FIGS. 7 shows a corner substantially T-shaped block 20 which differs from the block 15 chiefly in that the key 17′ of one branch of the cross limb 14 is arranged at a rear face of that cross limb. FIGS. 8 show two blocks 20 interfitted correspondingly to the blocks A and B in FIG. 1.

The substantially T-shaped blocks of FIGS. 6 to 8 are, in any construction employing them, keyed to their neighbors on two sides and this produces equilibrium among the forces acting on each block. It is noted that Z-keyed blocks are usable in slab form as floors and also in slab form as roofs which latter can be employed either with, or without, additional supports.

There are four basic versions of the embodiment of the system which principally uses substantially T-shaped building blocks. These four versions have been found to be the most satisfactory as regards ease of construction, handling, simplicity, ease of production of the blocks, versatility in use of the blocks and the need to produce a minimum number of accessory blocks for use at, for example, wall ends and wall junctions. The first of these four versions is illustrated in FIGS. 1 and 2, the second in FIGS. 9 to 13, the third in FIG. 26 and the fourth in Figure 15. It will be apparent that the versions shown in FIGS. 9 to 15 inclusive employ the substantially T-shaped blocks lying perpendicularly to the wall (i.e. with their cross limbs in the general plane of the wall and their stem limbs perpendicular to that plane.

Figure 10A:
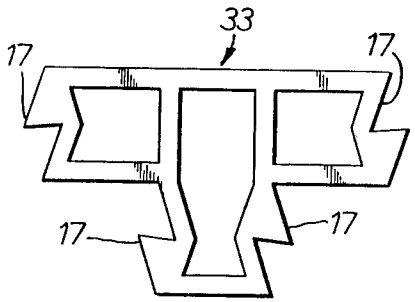
FIGS. 10A and 10B shows a plan view and a perspective view of a modified version of the block of FIGS. 1 and 2 for use in the walls of FIG. 9.
Figure 10B:
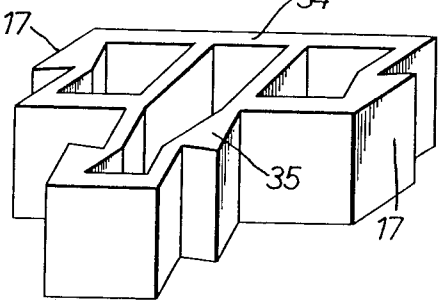
Figure 9:
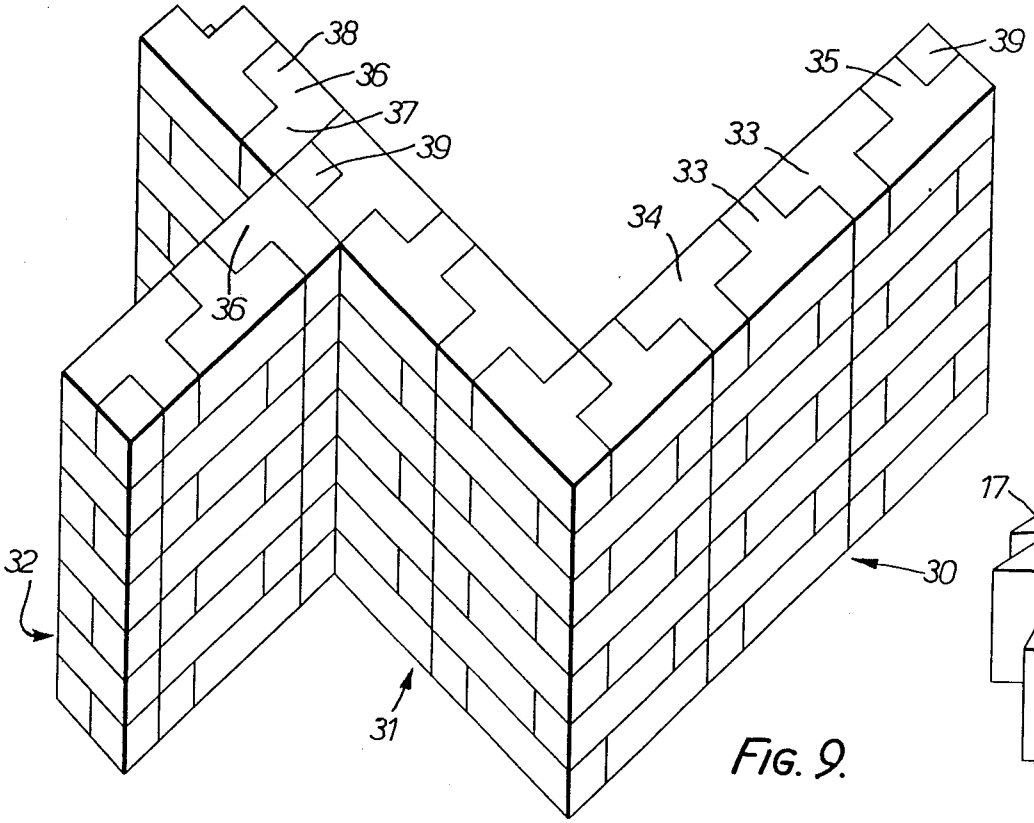
FIG. 9 shows a perspective view from above of three walls built of the block of FIGS. 1 and 2.
Figure 11:
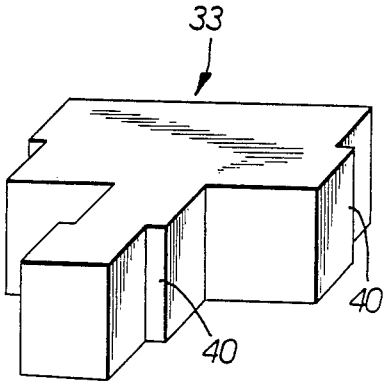
FIG. 11 shows a view similar to FIG. 10B of a modified version of the block therein.
Figure 12:
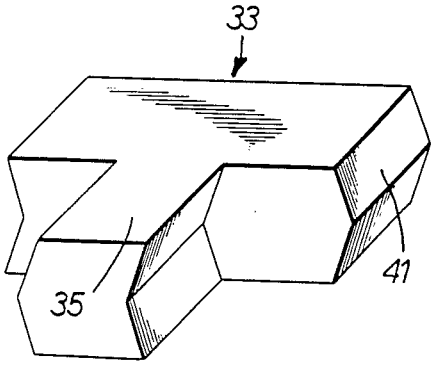
FIG. 12 shows a view similar to FIG. 10B of another modified version of the block therein.
Figure 13:
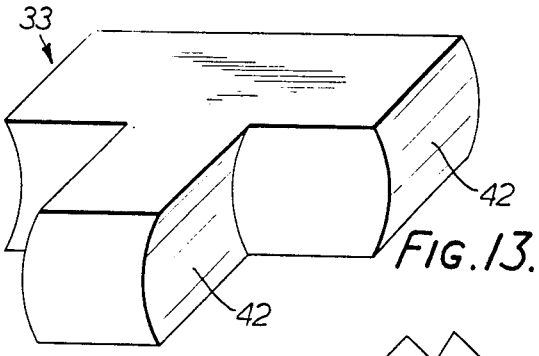
FIG. 13 is a view similar to FIG. 10B of a further modified version of the block therein.

Referring to FIG. 9, the vertical walls 30, 31 and 32 extending perpendicularly to each other consist of substantially T-shaped identical blocks 33 with cross limbs 34. The cross limbs 34 are three units long and one unit wide and stem limbs 35 one unit square. The substantially L-shaped identical blocks 36 have stem limbs 37 two units long and one unit wide and cross limbs 38 one unit square, and identical square-section blocks 39 one unit square. FIGS. 10 shows one of the blocks 33 with the end faces of its cross limb 34 and the lateral faces of its stem limb 35 consisting of substantially Z-form identical keys 17 which differ from the keys 17 of FIGS. 6 only in that their faces are perpendicular to the plane of the block. FIG. 11 shows a block 33 differing from that of FIGS. 10 only in that it has substantially Z-form keys 40 whereof the limbs of the substantially Z-shape are at right angles to each other. The block 33 of FIG. 12 is usable in walls according to both FIGS. 1 and 9 and has its keys 41 of substantially V-shape with the limbs of the substantially V-shape lying in a plane perpendicular to the axis of the stem limb 35. The block 33 of FIG. 13 differs from that of FIG. 12 only in that its keys 42 are of a cylindrical concave or cylindrical convex form.

Figure 14:
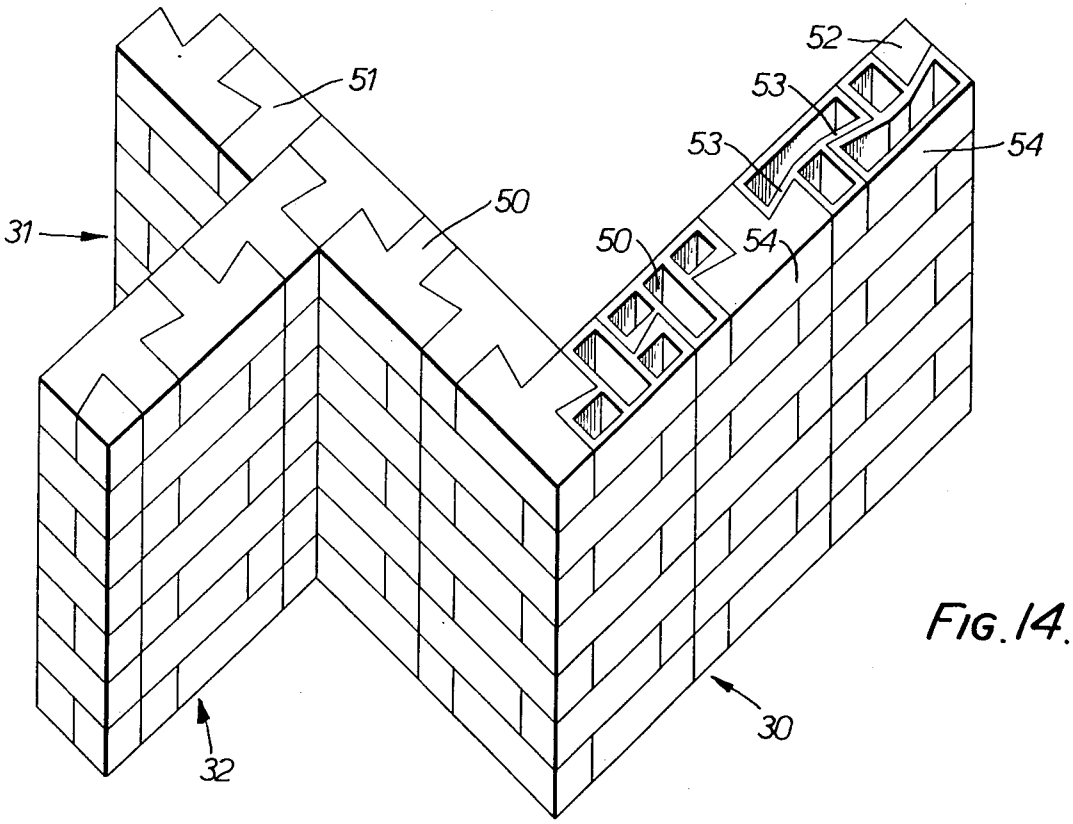
FIG. 14 is a view similar to FIG. 9 showing the walls built of a further modified version of the substantially T-shaped block.

FIG. 14 shows the walls 30 to 32 constructed of substantially T-shaped blocks 50, substantially L-shaped blocks 51 and substantially square-section blocks 52. FIG. 14 differs from the blocks of FIG. 9 chiefly in that the substantially T-shaped blocks each have one or both of those two faces 53 thereof intermediate the end faces of its cross limb, on the one hand, and the lateral faces of its stem limb, on the other hand, converging towards that face 54 of the cross limb opposite the stem limb.

Figure 15:
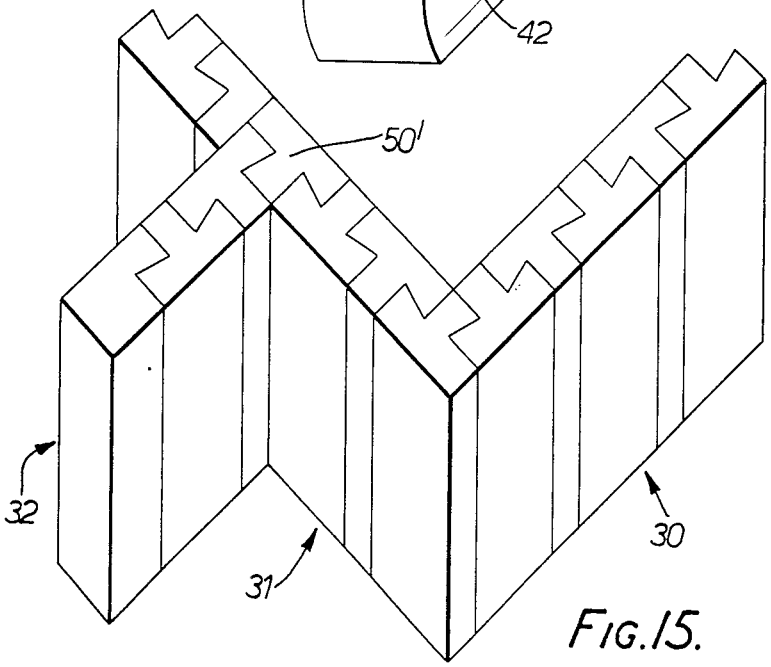
FIG. 15 is a view similar to FIG. 9 showing the walls built of a variation of the block therein.

In the version of FIG. 15, each substantially T-shaped block 50′ is of elongate formation.

Each of the four versions of the embodiment of the system which principally employs substantially T-shaped blocks may be solid, or wholly or partly hollow, and may have plain and/or patterned or other textured faces. It will be apparent that many different combinations of precise shape, size, materials, surface texturing and so on are possible that are too numerous to discuss individually. The particular type which is chosen will depend upon individual preference, climatic conditions, geographic situation and local traditions of building. It is noted that, whilst prefabricated concrete will generally be employed and most blocks will be hollow in construction, other materials can equally well be used, if preferred, such as pre-stressed concrete to form blocks usable for vertical walls, floors, roofs and so on, but a construction employing concrete is not essential and the blocks can be made from, for example, glass-reinforced plastics, natural wood and/or plywood.

The use of the building system which has so far been described enables strong buildings or other structures to be made either in dry form or semi-dry form using considerably less mortar or other binding material than is employed in the formation of traditional brick/block buildings and the like. The described system has numerous advantages as compared with traditional building systems. These advantages include stability both during and after erection of a building or other structure, ease of erection, simplicity in aligning the blocks without long experience of such work being necessary, and the use of an absolute minimum of auxiliary tools, measuring instruments and other gadgets. The blocks can be such as to interkey, giving increased strength to the vertical wall, floor, roof or the like which is being produced simultaneously. The blocks will eliminate errors such as discrepancies in level and the formation of crooked, zig-zag, curved or other incorrectly disposed courses of blocks. The system is versatile since it can employ different forms of keying and can employ any chosen one, or any chosen suitable combination, of the different blocks that have already been described and those that will be described below. As well as being very suitable for the construction of dwelling houses and other buildings, the system can be used for many other purposes such as, for example, the paving of roads, pathways, pavements and the like and for the cladding of new or existing buildings. Although the blocks will usually be formed from conventional concrete, they can, as has already been mentioned above, be formed from other materials which include, in addition to the examples already mentioned, light-weight concrete, clay, gypsum and synthetic plastics whether or not reinforced with glass fibre or the like. Where appropriate, buildings or other structures can be produced without mortar or other binding material between the blocks but grouted cavities can be included, where required, for strength or insulation. If required, a building or other structure can be formed in such a way as to be capable of being readily dismantlable by including therein removable keying blocks or removable locking bolts. The blocks may be given surface textures designed to simulate the use of a traditional method of construction when viewing the exposed surfaces of a building or other structure formed from such blocks.

It has been found that, using principally the substantially T-shaped blocks to form a building or other structure, those blocks, when accurately produced, fit together in the manner shown in FIGS. 1 and 2 of the drawings in such a way as automatically to prevent inaccuracies in horizontal or vertical disposition, provided only that the foundation or footing is itself correctly disposed. The interengagement of the blocks automatically prevents vertical and horizontal inaccuracies from occurring. The fact that the blocks fit tightly together produces a strength which is comparable with that achieved by using traditional bricks or blocks that are connected to one another by mortar or other binding material. Considerable time is, of course, saved by wholly or principally omitting mortar or other binding materials since the builders do not have to wait for the mortar or the like to set before the blocks can be relied upon for supporting purposes. Although the blocks are pre-fabricated, a building or other structure which is to be formed principally therefrom is actually constructed in a very similar manner to the use of traditional bricks and blocks except that, generally speaking, mortar is used very sparingly, if at all. The final building or other structure will not have the appearance of a monolithic concrete mass but rather the appearance of a somewhat differently patterned, but otherwise traditional, block or brick construction, thus avoiding an unusual external appearance which tends to discourage builders and the customers for their products. Builders that work substantially only in the traditional way will find no difficulty nor strangeness in using this system since the system comprises placing a large number of relatively small blocks in pre-determined positions relative to one another as is, of course, done when using traditional bricks and building blocks.

As well as being employed in the construction of actual buildings, paths, roads and the like and the cladding of new or existing buildings, this system can be employed in producing either permanent or temporary shuttering, substantially T-shaped blocks which are formed from glass fibre reinforced plastics or wood being particularly suitable for shuttering purposes. If exceptional strength is required in the blocks, they may be formed from glass fibre reinforced concrete. However, the particular choice of material will naturally depend upon the nature of the building or other structure that is to be formed and the purpose for which it is required. The hollow interiors of the blocks can, for extra strength, be filled with concrete or cement grout and it is possible to insert reinforcing bars into those interiors, before pouring the concrete or grouting. It has already been mentioned that the hollow blocks can be filled with insulation material, such as urea-formaldehyde foam, by either pouring or injection.

The system is particularly convenient for forming temporary buildings or other structures since the blocks and other necessary items can be supplied in a partially assembled condition with post units bolted to beam units merely requiring the interlocking blocks to be correctly positioned. Under such circumstances it is, of course, necessary that provision should be made for disassembling the temporary building or other structure in one of the ways briefly discussed above.

It will be realized that the blocks that have been described can be provided in any required sizes although it is desirable that the size and weight should not exceed that which can readily be handled by a single workman. The blocks that have briefly been described with reference to FIG. 15 can, on the other hand, be of such a size that mechanical assistance is required to move them. It is possible to provide blocks other than those shown in FIG. 15 to form a range of modular units that are basically of T-shaped cross-section together with accessory units as may be required at wall ends, wall junctions, the margins of access openings and the like. The second and third versions of the substantially T-shaped blocks may, if required, be of brick-sized dimensions and may be made from baked clay and other materials from which conventional bricks are formed. In a building or other structure using such bricks, it is desirable to grout the junctions between them at regular intervals, as may be necessary having regard to the particular building or other structure that is being produced. In the case of hollow blocks of this form, the block may be filled with mortar to produce columns or pillars and to strengthen the construction at the junctions between walls.

When erecting a building or other structure using the first version of the blocks that has been described with reference to FIGS. 1 and 2 of the drawings, it will be remembered that these blocks do not possess any interkeying features and it is therefore desirable, although not absolutely essential in all cases, to use mortar, grouting or other binding material in each pair or tier of blocks, using further mortar, grouting or other binding material between superposed pairs or tiers of blocks. The blocks that are required at the corners and ends of walls are basically similar to the substantially T-shaped blocks themselves, except the form of keying matches that employed in the substantially T-shaped blocks.

Figure 26:
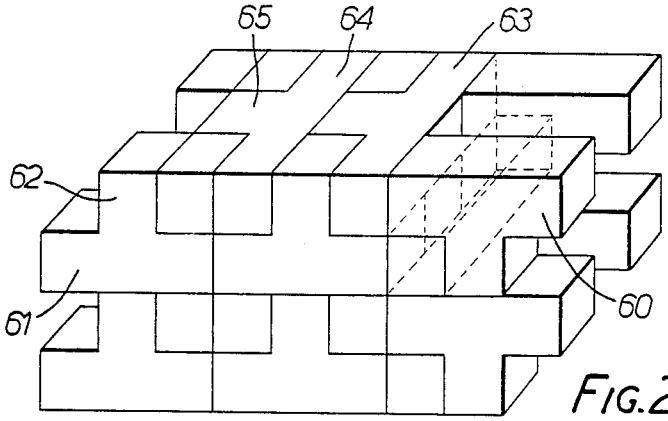
FIG. 26 shows a fragmentary perspective view of a wall comprised of the block of FIGS. 1 and 2.

In employing the third version shown in FIG. 26 to form a building or other structure, much the same technique is used as with the first version but the relative disposition of the blocks is different. The substantially T-shaped blocks 60 with cross limbs 61 and stem limbs 62 in the general plane of the wall interfitting with substantially T-shaped blocks 63 with cross limbs 64 and stem limbs 65 perpendicular to the limbs 61 and 62, respectively. The thicknesses of the substantially T-shaped blocks employed can be varied, and in particular reduced, to allow different external patterns to be produced together with different relative dispositions of the blocks. This third version can, if desired, be combined with the second version, using the two versions alternately in successive tiers of the blocks.

A second basic embodiment of this building system employs blocks that are not T-shaped but that co-operate with one another by way of keys that are still substantially Z-shaped. Such blocks are particularly, but not exclusively, useful in forming prefabricated panels, partitions and the like. A minimum of mortar or other binding material is required at the junctions between the blocks.

The substantially Z-shape of the key can be varied but it has been found convenient to employ four basic forms of the key any of which will join the blocks quickly and effectively together without essentially employing any mortar or other binding material.

It is possible to build a wall or other structure employing substantially Z-keyed blocks in a semi-dry form, overlaying every tier of the blocks with mortar or other binding material to secure the superposed tiers together in a conventional way. If a fully dry construction is preferred, it is desirable to incorporate end keying systems of substantially V-form, substantially arcuate, or substantially Z-form into the blocks to ensure that a building or other structure can be erected quickly and accurately whilst automatically maintaining stability and both vertical and horizontal alignment.

Figure 16C:
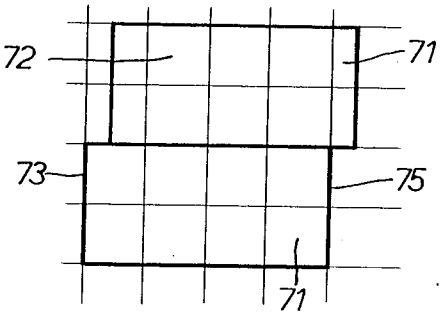
FIGS. 16A, 16B and 16C are a perspective view, a plan view and a side elevation of a substantially Z-shaped block of the system.
Figure 16B:
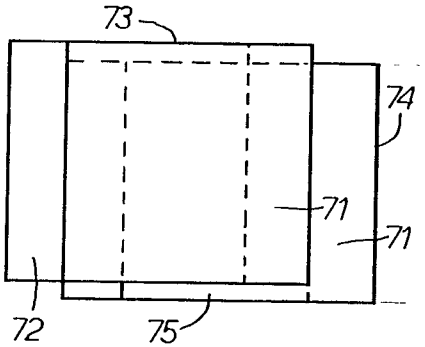
Figure 16A:
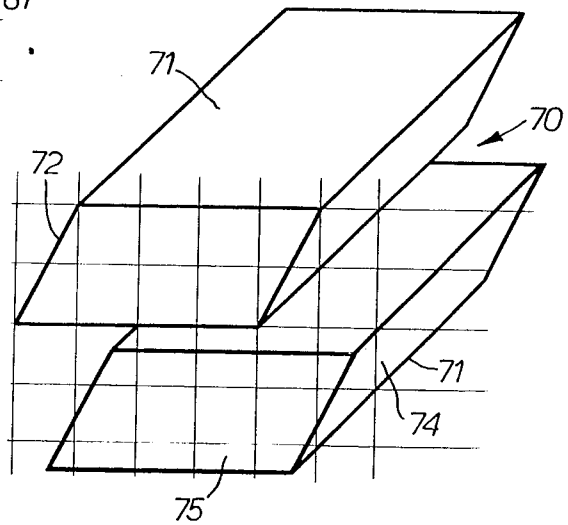

FIG. 16 shows a substantially Z-shaped block 70 consisting of two block-form parts 71 of which one part protrudes beyond the other on two of the six sides thereof and of which the other part protrudes beyond the one part on another two of the six sides. As a result of such protrusion, substantially four Z-shaped keys 72 to 75 are formed at the four sides, the substantially Z-shapes of the two opposite keys 72 and 74 being parallel and identical and of an acute-angled form, whilst the substantially Z-shapes of the two opposite keys 73 and 75 are of a right-angled form although parallel and identical to each other. As can be seen from the grids in FIGS. 16A and 16C, each block 70 is four units high, and each part 71 being two units high. The top and bottom faces of the block are each four units square; the intermediate limbs of the substantially Z-shape of the keys 72 and 74 are each two units long; the mid-point of the substantially Z-shape of each of the keys 72 and 74 is in a straight line with the free ends of that shape; and the intermediate limb of the substantially Z-shape of each of the keys 73 and 75 is one-third unit long.

Figure 17B:
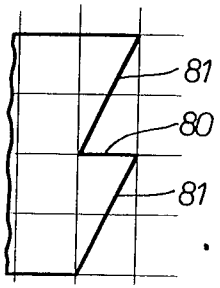
FIGS. 17A, 17B and 17C are end elevations of respective versions of a substantially Z-form key applicable to various of the blocks of the system.
Figure 17C:
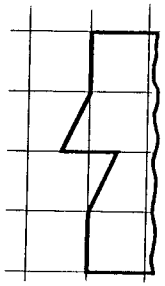
Figure 17A:
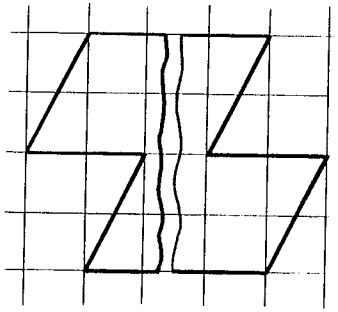

FIGS. 17A, 17B and 17C show three different forms of acute-angled, substantially Z-shaped key. The key of FIG. 17A is that of FIGS. 6, 7, 8, 10 and 16. Figure 17B shows a key whereof the intermediate limb 80 is one unit long and the other two limbs 81 each extend, as measured in a direction parallel to the limb 80, one unit. In FIG. 17C, the key is similar in proportions to the key of FIG. 17A, but extends over only two units of the four-unit height of the block.

Figure 18:
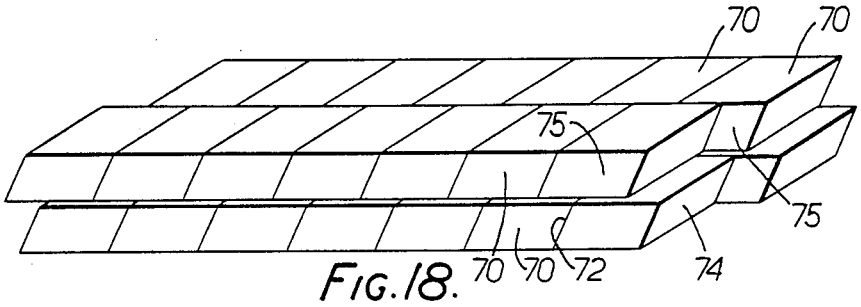
FIG. 18 shows a perspective view of part of two interkeying courses of the block of FIG. 16A.

FIG. 18 shows two courses of the blocks 70, illustrating that not only do the blocks interkey in each course by means of the keys 72 and 74 but the blocks interkey between courses by means of the keys 73 and 75.

Figure 19:
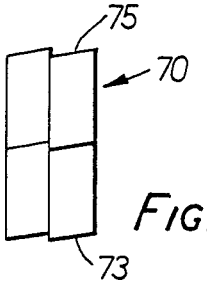
FIG. 19 shows an end elevation of the two courses of FIG. 18, but with a variation of the block of FIG. 16A.

FIG. 19 shows that the keys 73 and 75 may also be of an acute-angled, substantially Z-shape.

Figure 20:
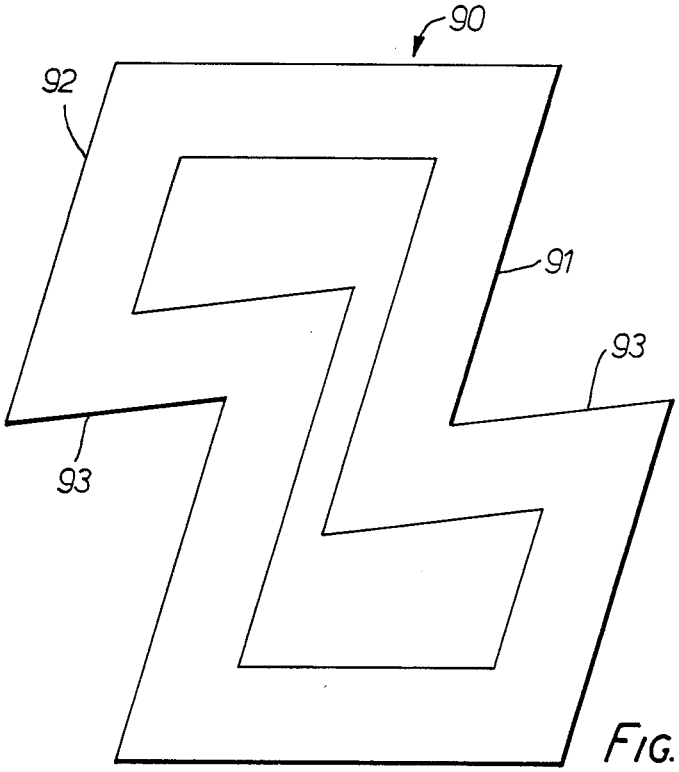
FIG. 20 shows a modified version of the block of FIG. 16A.

FIG. 20 illustrates a substantially Z-shaped block 90 with acute-angled substantially Z-shaped, parallel, identical keys 91 and 92, the intermediate limb 93 of each substantially Z-shape extending obliquely inwards.

Figure 21:
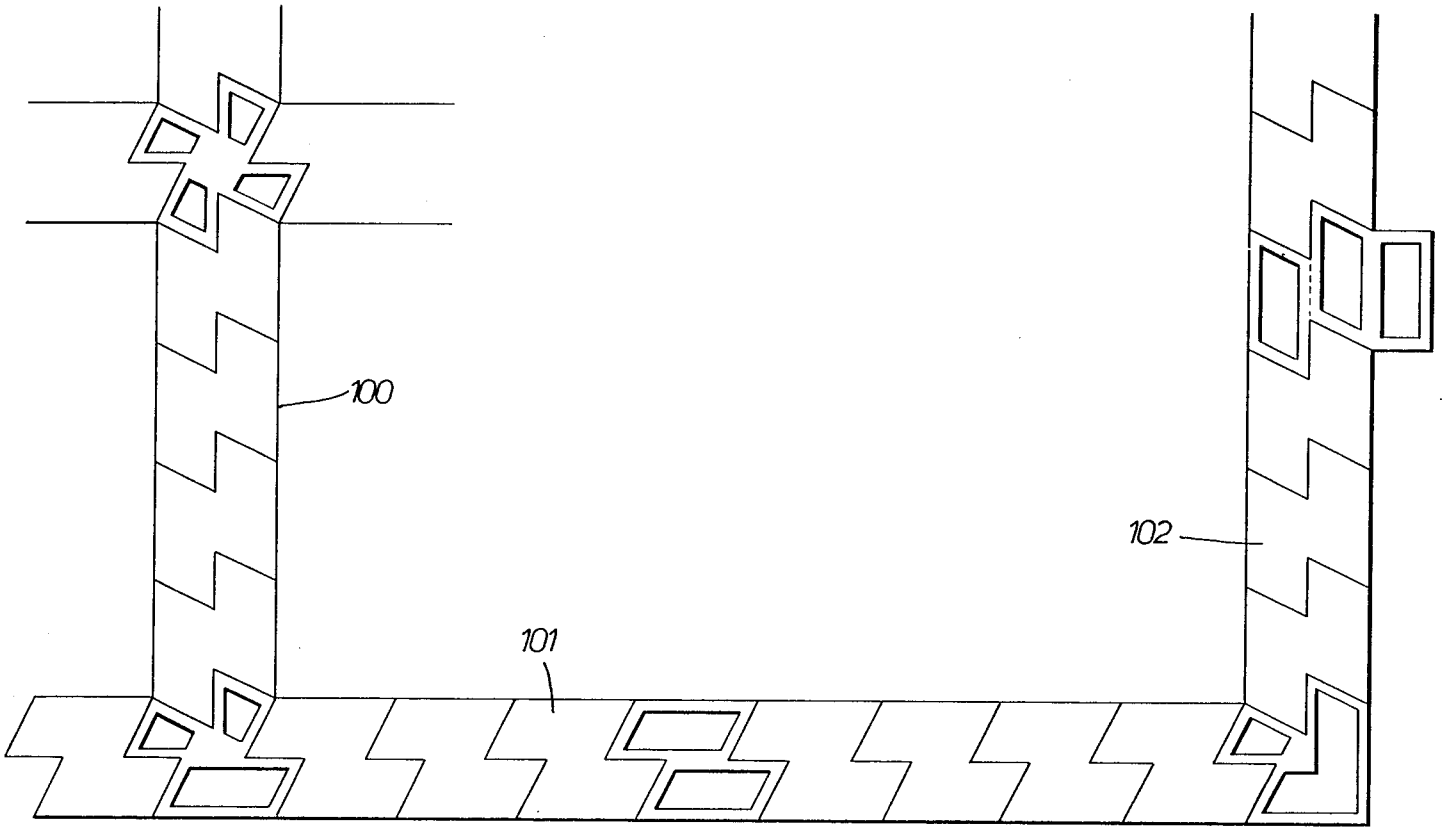
FIG. 21 shows a fragmentary plan view of walls comprising the block of FIG. 16A.
Figure 22A:
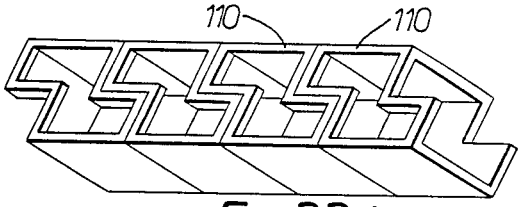
FIG. 22A shows a perspective view of part of a course of another modified version of the block of FIG. 16A.
Figure 22B:
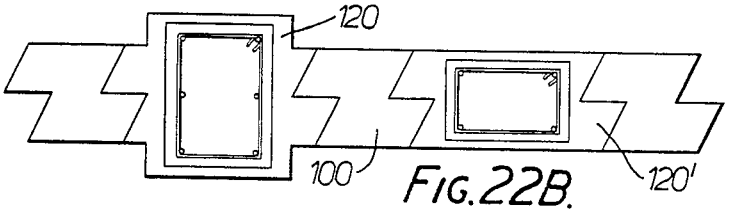
FIG. 22B shows a detail of FIG. 21, but modified.

FIG. 21 is a plan view showing vertical walls 100 to 102 of a building that are formed by employing hollow blocks exhibiting the key of FIG. 17A, but FIG. 21 also shows the shapes of blocks that are required at a right-angled junction between two walls, two forms of T-junction between walls, and a cruciform junction between four walls, FIG. 22A illustrates hollow, substantially Z-form keyed, substantially Z-shaped blocks 110 which are used as permanent formwork for the construction of beams together with details of one way of fitting those blocks 110 together. FIG. 22B shows the shape of auxiliary hollow blocks 120, 120' that may be used surroundingly to support upright reinforcing rods or the like that are interconnected by strengthening wires.

The substantially Z-shaped blocks that have been described herein can be employed in much the same situations as the substantially T-shaped blocks discussed above and, to a large extent, have the same advantages, as compared with the blocks that are employed in conventional building systems, as do those above-discussed blocks.

Figure 23A:
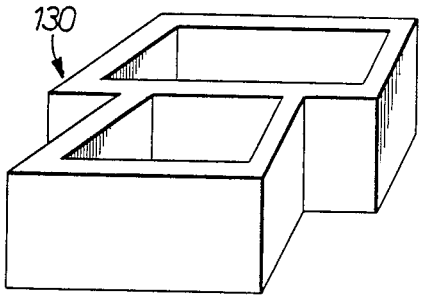
FIGS. 23A and 23B show a perspective view and a plan view of a substantially dovetailed-T-shaped block of the system.
Figure 23B:
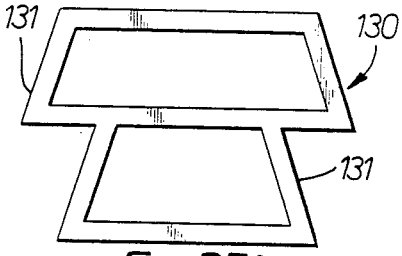

There now follows with reference to FIG. 23 a description of a third basic embodiment of blocks employable in a building system which blocks 130 are of dovetailed substantially T-shape and will hereinafter be called, for the sake of brevity, "dove" blocks. Such blocks are again particularly, but by no means exclusively, useful in constructing pre-fabricated panels, partitions and the like, very little, if any, mortar or other binding material being required at the junctions between the blocks. The dove blocks again employ substantially Z-form keys for interengagement and, once again, these keys may be of various shapes but conveniently are provided in four different versions as has already been described above with reference to FIGS. 17 to 20.

Again, as already briefly described with reference to FIGS. 16 to 22, the dove blocks can advantageously be used in buildings or other structures of semi-dry form, each tier of dove blocks being overlaid with mortar or other binding material to secure it to the superposed tier in a substantially conventional manner. Again, if a substantially fully dry construction is required, it is preferable for the dove blocks to incorporate end keys of one of the same forms, and for the same purposes, as have already been mentioned with reference to FIGS. 16 to 19.

Each dove block is actually shaped to comprise two substantially Z-shaped keys 131 each extending over the whole of one side of the block. This form of block has the particular advantage that, in use, the forces acting on the opposite ends thereof will almost always substantially counterbalance one another so that a particularly structurally stable building will result.

The dove blocks 130 have substantially the same versatility of usage, and advantages as compared with the bricks or blocks that are employed in conventional building systems, that have already been discussed above in regard to the version of the system which principally employs substantially T-shaped blocks.

Figure 24:
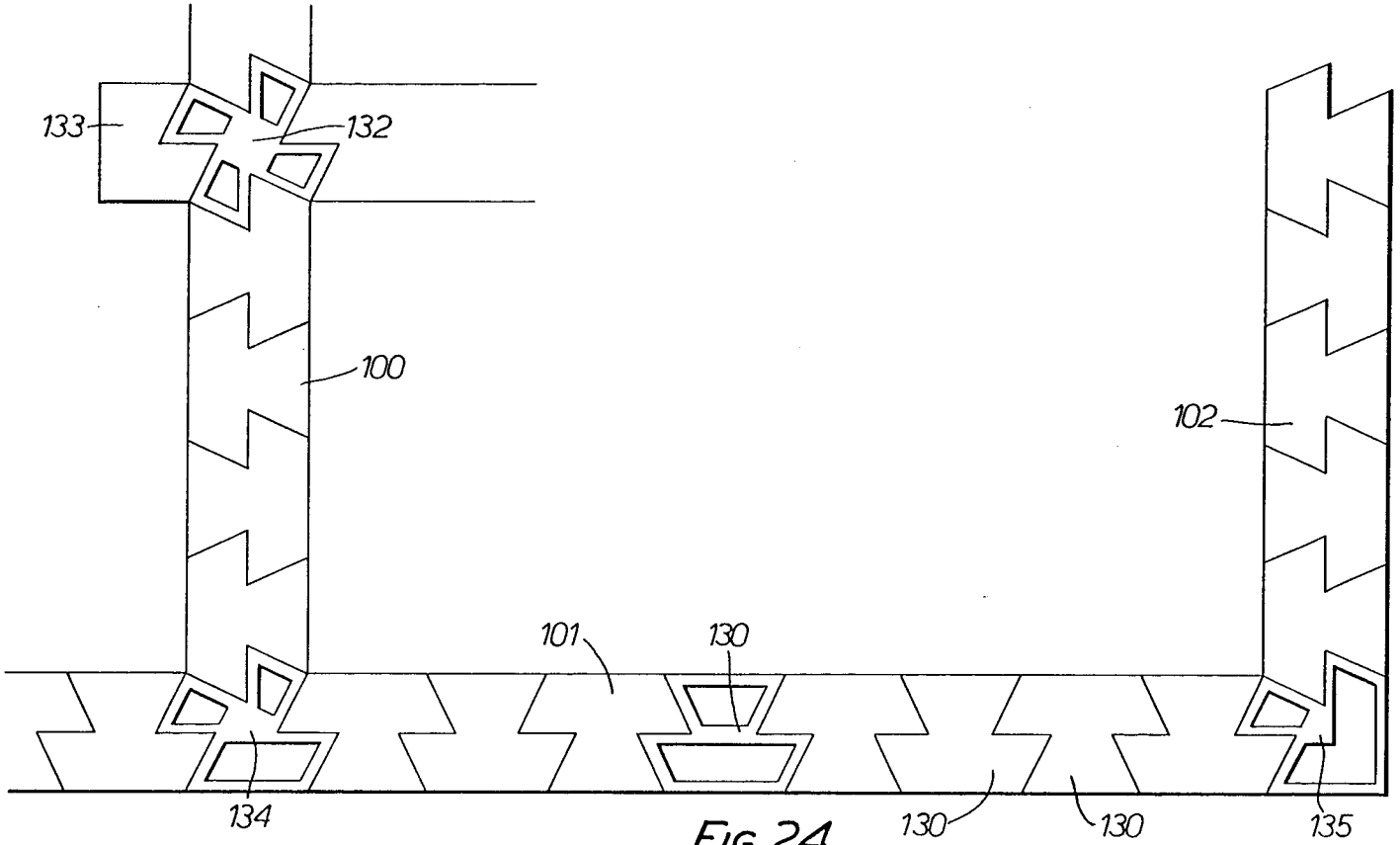
FIG. 24 shows a view similar to FIG. 21 of the walls comprising the block of FIG. 23A.

FIG. 24 is a plan view, somewhat similar to FIG. 21, showing a plurality of the hollow dove blocks 130 employed in vertical walls 100 to 102 which also include matchingly shaped cruciform connecting blocks 132, "half" wall end blocks 133, T-junction blocks 134 and right-angled corner blocks 135.

A description will now be given of ways in which the various forms of block that have so far been described can be employed in forming buildings and other structures. When substantially T-shaped or other blocks of the kind that have been described, having substantially Z-form keys, are used in co-operation with one another, the keys will effectively lock adjoining blocks together by directing the forces which act upon the junctions between the blocks and otherwise upon the blocks themselves in such a way as to enhance or reinforce the stability of the structure that is composed of said blocks. In particular, the keys transform the tensile forces to which the described blocks are subject into compressive forces which latter forces will not normally crush building materials of the kind used to produce blocks, unless these forces are excessively strong.

Figure 25:
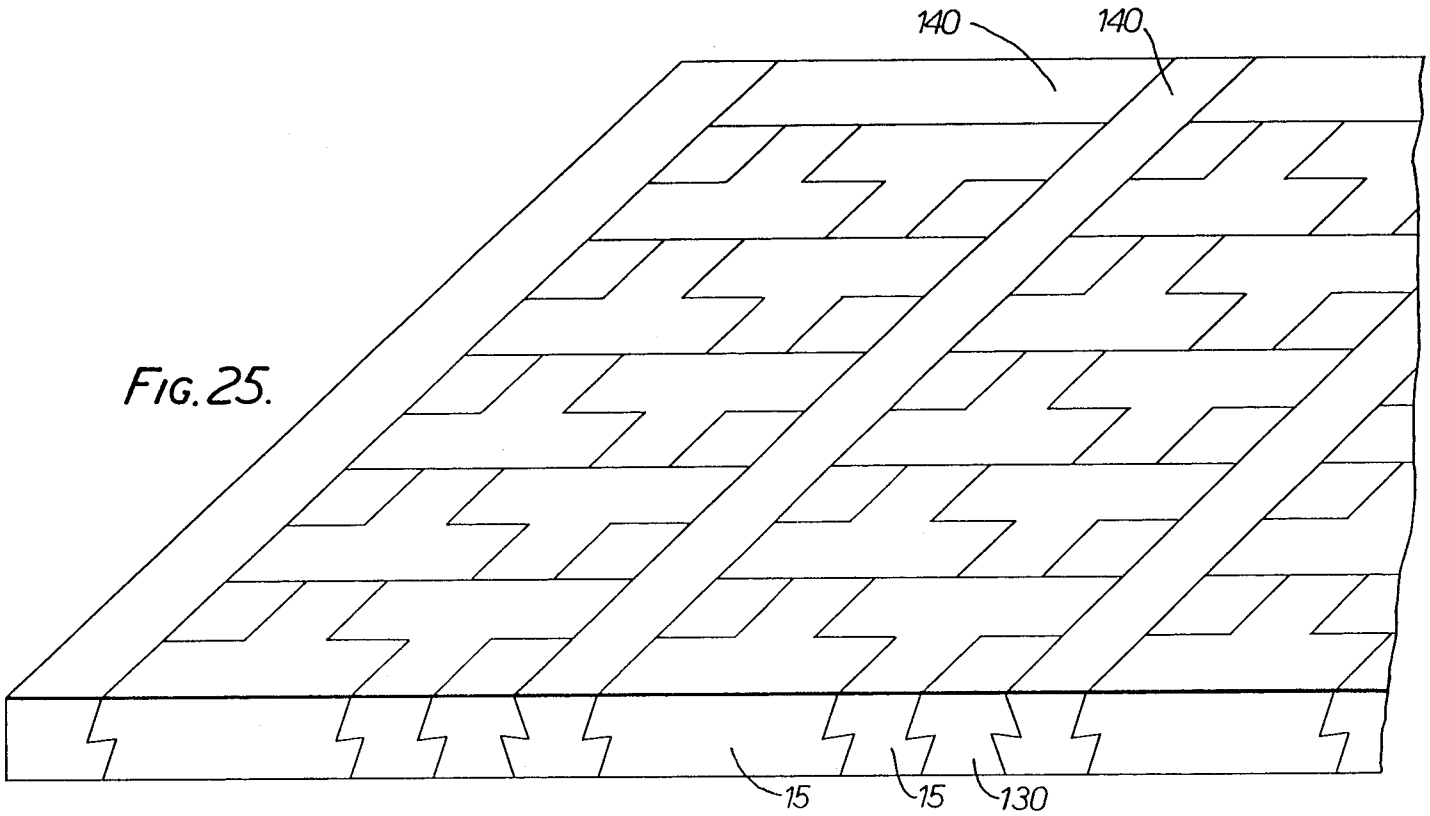
FIG. 25 shows a fragmentary perspective view of a horizontal wall, in this case a floor, comprised of the blocks of FIGS. 6A and 23A.

FIG. 25 illustrates one form of floor that may be constructed of substantially T-shaped blocks arranged with their stem limbs horizontal in a pre-cast concrete or steel beam or timber joist framework 140 that is of matching cross-sectional shape and that provides beams or joists at pre-determined substantially regular intervals. It will be noted that the substantially T-shaped blocks exhibit substantially Z-form keys of the kind shown in FIG. 20 and that similarly keyed dove blocks are also employed to fill the gaps which would be left if the substantially T-shaped blocks alone were used.

It is important, when using the blocks in the way that is illustrated in FIG. 25 that the blocks should be forced tightly against one another in a horizontal direction that is perpendicular to the lengths of the beams or joists of the co-operating framework. Under such circumstances, the blocks will co-operate effectively with one another to form a stable floor in which no underneath support, between the beams or joists, is necessary. A tie beam may often advantageously be employed to maintain the blocks firmly pressed against one another as just described, such tie beam being either pre-cast or cast in situ. The use of a tie beam for this purpose is particularly advantageous when the blocks are in the form of roof slabs. Obviously, there is a limit to the span of blocks which will remain reliably interconnected, without support, merely by the co-operation of their own interkeying portions, this limit being dependent upon the sizes of the blocks that are employed, the strength of the material from which they are made and the load that, in use, they will be called upon to bear. It is again possible to employ pre-cast or pre-stressed beams in supporting co-operation with the blocks, the blocks of a floor or the like that is formed in this way needing no mortar, grouting or other binding material.

If necessary, further strengthening can be produced by forming substantially Z-shaped keys on those surfaces of the floor blocks that are substantially perpendicular to the surfaces carrying the keys that have already been mentioned.

It can sometimes be an advantage to secure pre-cast or pre-stressed beams together to form a block in the form of a frame. This has the advantage that the beams will be lighter in weight than is conventional, thus avoiding the need for heavy lifting machinery and other mechanical handling equipment to move various parts of the building or other structure that is being erected into their appointed positions. Once again, if the beams are provided with substantially Z-form keying as described above, the advantage that the blocks automatically position themselves relative to one another in both vertical and horizontal directions is immediately attained. Also, since no mortar or other binding material is really necessary between the automatically interlocking blocks, a roof can be placed on a building or other structure erected using this system without having to wait for mortar or other binding material to set and attain a required degree of strength.

I claim:

1. A planar wall comprising: a plurality of basically T-shaped, unitary, building blocks each having front and rear faces and two limbs which are a stem limb having a free end face and two lateral faces on opposite sides of the stem limb and an elongate cross limb having two end faces and also having an outermost face opposite the stem limb, and two innermost faces nearer the stem limb and on opposite sides of the stem limb, the stem limb extending in a direction in a plane of the wall substantially perpendicular from a central portion of the cross limb between the two end faces of the cross limb, the longitudinal axis of the cross limb extending in the plane of the wall, and wherein inverted such blocks alternate with upright such blocks proceeding along a row of blocks, the free end faces of the stem limbs of the inverted blocks and the upright such blocks being substantially co-planar with such outermost faces of the cross limbs of the outermost blocks and the inverted blocks, respectively, and further comprising complementary keys formed on the blocks and interengaging one another, the interengagement having taken place in said direction, and the keys comprising surface portions which are inclined to the normal to said plane and which bear against each other to obstruct displacement of the blocks relative to one another normally to said plane, said keys being on first, second and third faces parallel to each other and selected from said free end face, said two lateral faces, said two end faces, said two outermost faces and said two innermost faces of each block.

2. A wall according to claim 1, wherein said keys are of substantially arcuate form in planes perpendicular to the longitudinal axes of the stem limb.

3. A wall according to claim 1, wherein said keys are formed at said two end faces and said free end face of each block.

4. A wall according to claim 1, wherein said keys take the form of complementary tapered projections and depressions, at said free end face, said outermost face and said two innermost faces of each block, the tapered projections and depressions being in the form of substantially closed loops.

5. A wall according to claim 1, wherein said keys are of substantially Z-form in planes perpendicular to the longitudinal axes of the stem limbs.

6. A wall according to claim 1, wherein the substantially Z-form of said keys is acute-angled.

7. A wall according to claim 1, wherein said keys are of substantially V-form in planes perpendicular to the longitudinal axes of the stem limbs.

8. A process of building a planar wall, which comprises:

providing a plurality of basically T-shaped, unitary building blocks, each block having front and rear faces and two limbs which are a stem limb with a free end face and two lateral faces on opposite sides of the stem limb, and an elongate cross limb with two end faces, each cross limb having an outermost face opposite the stem limb and two innermost faces nearer the stem limb and on opposite sides of it, the stem limb extending substantially perpendicularly from a central portion of the cross limb between the two end faces of the cross limb;

assembling the blocks together such that some of the blocks are in an inverted position and some of the blocks are in an upright position, the inverted blocks alternating with the upright blocks proceeding along a row of blocks, the free end faces of the stem limbs of the inverted blocks and the upright blocks being substantially co-planar with such outermost faces of the cross limbs of the upright blocks and the inverted blocks respectively; and engaging complementary keys of the blocks so that each block bears against adjacent blocks to obstruct displacement thereof, enabling interlocking cooperation with the adjacent blocks in the wall, said keys being on first, second and third faces parallel to each other and selected from said free end face, said two lateral faces, said two end faces, said two outermost faces and said two innermost faces of each block.

9. The process of claim 8, wherein each of the blocks has complementary keys formed on a surface thereof which engage each other, the keys having tapered projections and depressions which are inclined relative to the normal to the plane of the wall.

10. A wall constructed by the process of claim 8.

11. A planar wall structure substantially precluding the use of mortar, the wall structure consisting essentially of a plurality of basically T-shaped, unitary, building blocks each having front and rear faces and two limbs which are a stem limb having a free end face and two lateral faces on opposite sides of the stem limb and an elongate cross limb having two end faces and also having an outermost face opposite the stem limb, and two innermost faces nearer the stem limb and on opposite sides of the stem limb, the stem limb extending in a direction in a plane of the wall substantially perpendicular from a central portion of the cross limb between the two end faces of the cross limb, the longitudinal axis of the cross limb extending in the plane of the wall, and wherein inverted such blocks alternate with upright such blocks proceeding along a row of blocks, such blocks being alternated substantially throughout the wall, the free end faces of the stem limbs of the inverted blocks and the upright such blocks being substantially co-planar with such outermost faces of the cross limbs of the outermost blocks and the inverted blocks, respectively, and further comprising complementary keys formed on the blocks and interengaging one another, the interengagement having taken place in said direction, and the keys comprising surface portions which are inclined to the normal to said plane and which bear against each other to obstruct displacement of the blocks relative to one another normally to said plane.

12. The planar wall structure of claim 11, wherein said keys are on first, second and third faces parallel to each other and are selected from said free end face, said two lateral faces, said two end faces, said two outermost faces and said two innermost faces of each block.

* * * * *